US005865305A

United States Patent [19]

Yasoshima

[11] Patent Number: 5,865,305

[45] Date of Patent: Feb. 2, 1999

[54] STENCIL CASE AND STENCIL SET IN A CASE

[75] Inventor: Rira Yasoshima, Tokyo, Japan

[73] Assignee: Tsukineko, Inc., Redmond, Wash.

[21] Appl. No.: 748,217

[22] Filed: Nov. 12, 1996

[51] Int. Cl.[6] ..... B41K 1/54

[52] U.S. Cl. ..... 206/1.7; 206/214; 206/224; 206/815; 118/264

[58] Field of Search ..... 206/214, 209, 206/361, 362, 371, 486, 562, 563, 564, 1.7, 1.8, 1.9, 224, 229, 575, 815; 220/524; 118/264, 269, 217, 255

[56] References Cited

U.S. PATENT DOCUMENTS

| | | | |
|---|---|---|---|
| D. 184,720 | 3/1959 | Fleming . | |
| D. 247,063 | 1/1978 | Funahashi . | |
| D. 252,935 | 9/1979 | Henkels . | |
| D. 331,418 | 12/1992 | Winston . | |
| D. 345,826 | 4/1994 | Byars et al. . | |
| D. 347,089 | 5/1994 | Byars et al. . | |
| D. 369,384 | 4/1996 | Yasoshima . | |
| D. 372,731 | 8/1996 | Yasoshima . | |
| 602,061 | 4/1898 | Echelberger . | |
| 680,658 | 8/1901 | Hastings | 206/1.8 |
| 848,063 | 3/1907 | Sommer . | |
| 1,173,092 | 2/1916 | Bickerton . | |
| 1,463,718 | 7/1923 | Munson . | |
| 1,598,538 | 8/1926 | Mann . | |
| 1,796,137 | 3/1931 | Baumgarten . | |
| 2,117,470 | 5/1938 | Zareko . | |
| 2,290,488 | 7/1942 | Munson . | |
| 2,374,198 | 4/1945 | Harris . | |
| 2,422,814 | 6/1947 | Alexander . | |
| 2,723,476 | 11/1955 | Lyon . | |
| 2,932,906 | 4/1960 | Chamberlin | 206/1.8 |
| 3,326,180 | 6/1967 | Lofgren . | |
| 3,389,945 | 6/1968 | Thomas | 206/1.7 |
| 3,590,734 | 7/1971 | Carter . | |
| 3,840,113 | 10/1974 | Bartleson | 206/224 |
| 4,029,011 | 6/1977 | Kurner . | |
| 4,708,817 | 11/1987 | Dudnick | 206/1.7 |
| 4,901,850 | 2/1990 | McIntosh | 206/1.7 |
| 4,972,943 | 11/1990 | Fludd | 206/1.7 |
| 4,979,612 | 12/1990 | Melbye | 206/216 |
| 4,986,175 | 1/1991 | Boehringer et al. . | |
| 5,150,794 | 9/1992 | Rooks | 220/524 |
| 5,449,071 | 9/1995 | Levy | 206/564 |
| 5,531,829 | 7/1996 | Yasoshima . | |
| 5,601,644 | 2/1997 | Yasoshima . | |

FOREIGN PATENT DOCUMENTS

| | | | |
|---|---|---|---|
| 546609 | 9/1957 | Canada . | |
| 167 380 A | 1/1986 | European Pat. Off. . | |
| 2675740 A1 | 10/1992 | France . | |
| 662905 | 6/1938 | Germany . | |
| 4-312881 A | 11/1992 | Japan . | |
| 4940 | 4/1896 | United Kingdom . | |
| 556979 | 6/1944 | United Kingdom | 206/1.8 |
| 2045687 | 11/1980 | United Kingdom . | |

OTHER PUBLICATIONS

Clearsnap, Color Box Pigment Stamp Pads, See circled stamp pad, top left, 1993.

Ink–A–Dink–A–Do, 4 Inks in Ones, Stamp Pad.

*Primary Examiner*—M. D. Patterson
*Assistant Examiner*—Luan K. Bui
*Attorney, Agent, or Firm*—Seed and Berry LLP

[57] ABSTRACT

A stencil case that makes stencil work efficient, and which allows organization and storage of ink pads and stencil brushes. The stencil case stores ink pads and stencil brushes, and has a base (1) and a lid, the base characterized by providing several ink pad storage slots (3) for storing different colors of ink pads in parallel in the base (1), and several brush storage slots (4) for storing as many stencil brushes as the number of ink pads in parallel and at a position opposite to the ink pad storage slots.

3 Claims, 8 Drawing Sheets

STENCIL CASE AND STENCIL SET IN A CASE

CROSS-REFERENCE TO RELATED APPLICATION

This application claims priority from Japanese patent application Ser. No. PWY 8002, filed Mar. 18, 1996, which is incorporated herein by reference in its entirety.

TECHNICAL FIELD OF THE INVENTION

The present invention pertains to stencil cases and to stencil sets in a case. In particular, the present invention pertains to a stencil case which stores different colors of ink pads and stencil brushes, and a stencil set which has ink pads and stencil brushes stored in the case.

BACKGROUND OF THE INVENTION

Conventionally, stencils are made as follows: stencils with letters, symbols, figures or designs punched through are fixed onto paper to which the stencil is to be applied. Watercolors, water paints, or stamp pad inks are applied onto a stencil brush. The ink is imprinted onto the paper by slightly tapping the stencil brush on the stencil, to transfer the ink from the brush to the paper. The stencil is then removed, and the letters, symbols, figures, or designs are copied to the paper.

When stamp pads are used for stenciling, it is typical to use commonly sold stamp pads of one color, which use one of various colors. An example of such a stamp pad is illustrated in FIG. 13, which shows a stamp pad having an ink occlusion body (32), such as sponge or felt which absorbs ink, which is placed on a base (31) to absorb pigment ink or dye ink, and having the top covered with a lid (33).

In addition to such monochromatic stamp pads, recently, multicolor stamp pads with several different colors of pads provided in parallel can be used. If such a stamp pad is used, several colors of stencils can be made using one stamp pad. FIG. 14 is a cross-sectional view that illustrates an example of a conventional multicolor stamp pad. As illustrated in FIG. 14, the conventional multicolor stamp pad is comprised of several different colors of color pads (43) with pigment ink absorbed in sponge ink occlusion bodies (42) that are disposed on a base (41), and arranged in parallel; the tops of such color pads (43) are covered with a lid (44).

Conventional stencil brushes were made by attaching animal hair, such as pig or horse hair, to the tip of a wood or bamboo handle, or by attaching a sponge ink absorbing part composed of polyurethane, etc., to the tip of a wood, bamboo, or plastic handle. Holding the handle of the brush in the same manner as holding a pencil, the user would color the paper with stamp pad ink by slightly tapping the brush onto the top of the stencil.

When stencils were made using monochromatic stamp pads as described above, only one stamp pad and one stencil brush were needed to stencil monochromatic letters, symbols, figures, or designs. However, to make stencils in two or more colors, there must be as many monochromic stamp pads as the number of colors, and one or more stencil brushes are needed.

When stencils were made in two or more colors using one stencil brush, each time different colors of ink were used, the stencil brush needed to be washed with water to remove the ink before applying another color. Thus, there was a problem that such work was troublesome and the work efficiency was low.

If more than one stencil brush is used to make two or more colors of stencils, the stencil brushes do not need to be washed with water. However, because the several monochromatic stamp pads and several stencil brushes are not arranged at predetermined positions, the stamp pads and the stencil brushes would be moved in the course of the work to different places and get disorganized; thus, the work cannot be performed efficiently.

As with the aforementioned monochromatic stamp pads, when two or more colors of stencils are made using a multicolor stamp pad with several different colors of color pads arranged in parallel, if one stencil brush is used, the stencil brush needs to be washed with water each time another color of ink is used. If several stencil brushes are used, such stencil brushes do not need to be washed with water, but the stencil brushes would be moved to different places during work; thus, the work efficiency will be low. Furthermore, another problem was that with a multicolor stamp pad using water-based ink, the ink tended to be transferred between adjacent color pads, which causes discoloration of color pads due to the ink transfer between them, and would make it impossible to maintain the original color.

Furthermore, when one or more conventional stamp pads and several stencil brushes are used as described, there was another problem that when the stencil work is completed, and such stamp pads and stencil brushes are stored, they tend to be disorganized.

The present invention was made to improve such problems of the prior art. The purpose is to offer a stencil case wherein several ink pads or stamp pads used for stenciling and several stencil brushes are stored in an arrangement that allows for them to be used conveniently to improve the work efficiency of stenciling and allows them to be stored in an organized manner. The present invention also offers a stenciling set in a case.

SUMMARY OF THE INVENTION

The present invention provides a stencil case to store ink pads and stencil brushes. The stencil case comprises a base and a lid, several ink pad storage slots to store several different colors of ink pads in parallel in the base, and several brush storage slots to store, in parallel, the same number of stencil brushes as the ink pads, at a position opposite to the ink pad storage slots.

Also, the present invention provides a stencil set that has ink pads and stencil brushes stored in a case having a base and a lid. The case for the stencil set comprises a base and a lid, several ink pad storage slots in the base to store several different colors of ink pads provided in one direction in parallel, and several brush storage slots to store as many stencil brushes as the ink pads in parallel at a position opposite to the ink pad storage slots.

In the present invention, the ink pads that are stored in several ink pad storage slots are preferably comprised by absorbing ink in an ink occlusion body. Also, it is preferable that an inner lid to cover and seal the ink pad storage slots where the ink pads are stored is provided.

As another example of ink pads stored in the ink pad storage slots, small stamp pads are preferably used which absorb ink in an ink occlusion body provided on the base and which are covered with a small lid. Such stamp pads can be fitted into the ink pad storage slots in such a manner that they can be freely inserted or removed. In such a case, a hole penetrating to the outside of the unit is preferably provided under the ink pad storage slot, so that the stamp pad can be inserted and removed easily.

In the brush storage slots, concave parts are preferably provided joining each of the brush storage slots parallel to the direction of arrangement.

The stencil brush preferably provides an ink absorbing part on a handle that is composed of buffer material or elastic material.

DETAILED DESCRIPTION OF THE INVENTION

Next, the present invention will be explained in concrete terms based on the figures.

Figure 1:
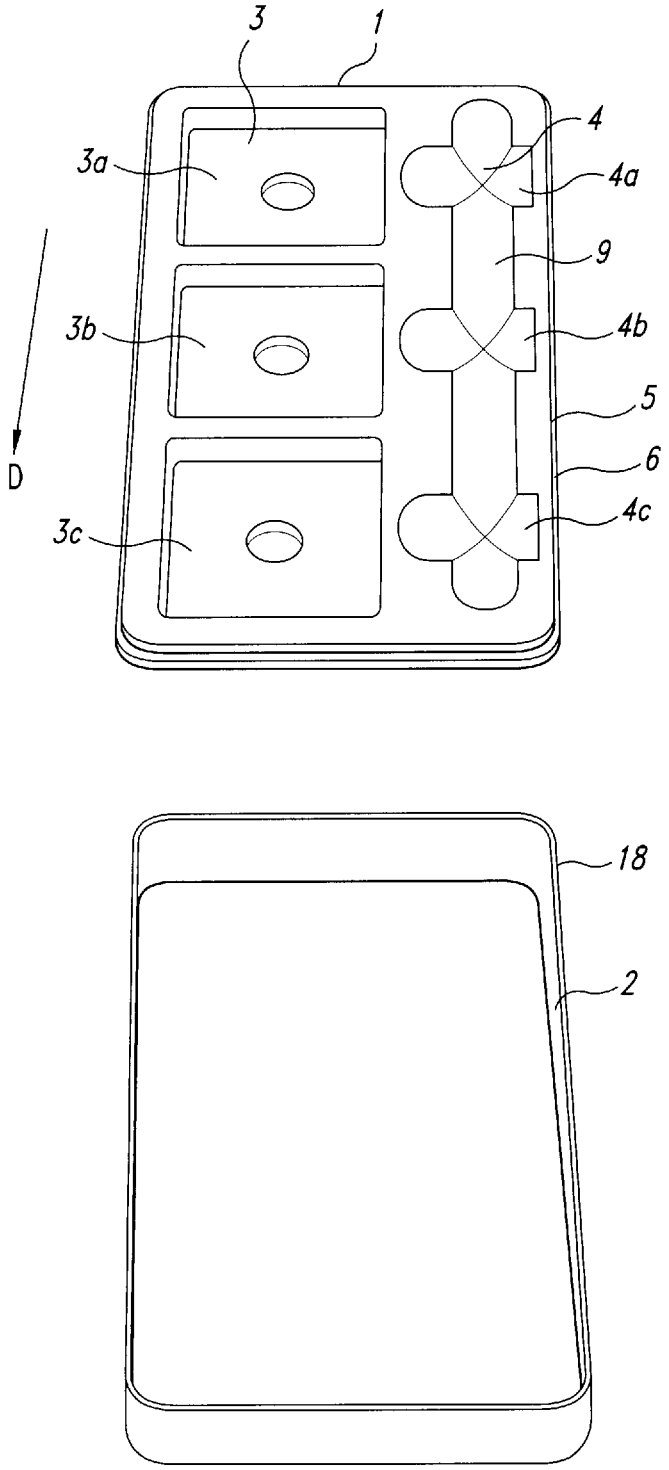
FIG. 1 illustrates an example of the stencil case of the present invention.

FIG. 1 is a diagonal view which illustrates an example of the stencil case of the present invention.

As illustrated in the figure, the stencil case of the present invention has a base (1) and a lid (2), and is a case to store ink pads and stencil brushes. The base (1) has three ink pad storage slots (3) for storing three different colors of ink pads in parallel, which is indicated by arrow (D). Three brush storage slots (4) for storing three stencil brushes, the same number as the ink pads, are provided in parallel, which is indicated with the arrow (D), so that brush storage slots (4*a*), (4*b*), and (4*c*) are provided at positions that are opposite to the ink pad storage slots (3*a*), (3*b*), and (3*c*), respectively. The unit (1) is formed so as to be covered with the lid (2). Around the peripheral part (5) of the base (1), step-formed slot (6) is formed. The edge (18) around the lid (2) will fit in the step-formed slot (6) to be closed, and it will be possible to fit or remove the lid freely.

Along the brush storage slots (4) of the base (1), a concave part (9) is provided to join each of the brush storage slots (4*a*), (4*b*), and (4*c*). The concave part is parallel to the arrangement direction which is indicated by the arrow (D).

FIG. 1 illustrates an example where three each of ink pad storage slots (3) and brush storage slots (4) are provided. The stencil case of the present invention may have any number of such slots as long as it is more than two and as long as the numbers of both slots are the same.

Figure 2:
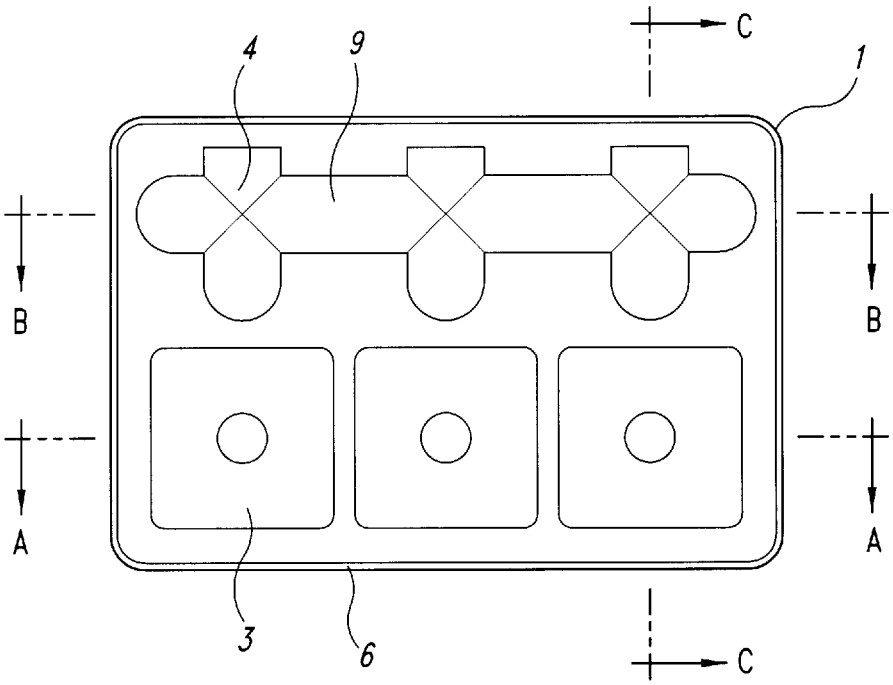
FIG. 2 is a top view that illustrates an example of the base of the stencil case of the present invention.
Figure 3:
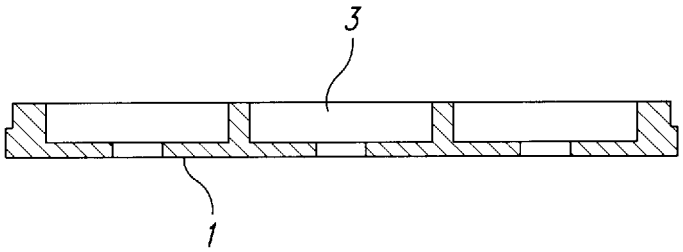
FIG. 3 is a cross-sectional view at the line (AA) in FIG. 2.
Figure 4:
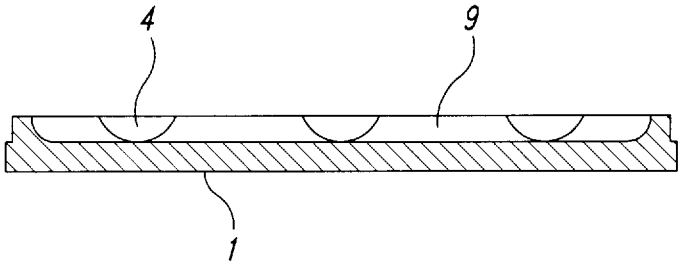
FIG. 4 is a cross-sectional view at the line (BB) in FIG. 2.
Figure 5:
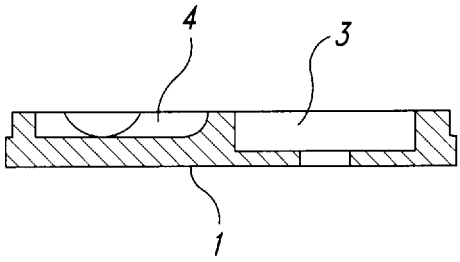
FIG. 5 is a cross-sectional view at the line (CC) in FIG. 2.

FIG. 2 is a top view which illustrates a stencil case base (1) of the present invention. FIG. 3 is a cross-sectional view along the line (AA) in FIG. 2. FIG. 4 is a cross-sectional view along the line (BB) in FIG. 2. FIG. 5 is a cross-sectional view along the line (CC) in FIG. 2.

The stencil set in a case of the present invention is a stencil set where ink pads and stencil brushes are stored in the stencil case having the base and the lid as illustrated in FIG. 1.

Figure 6:
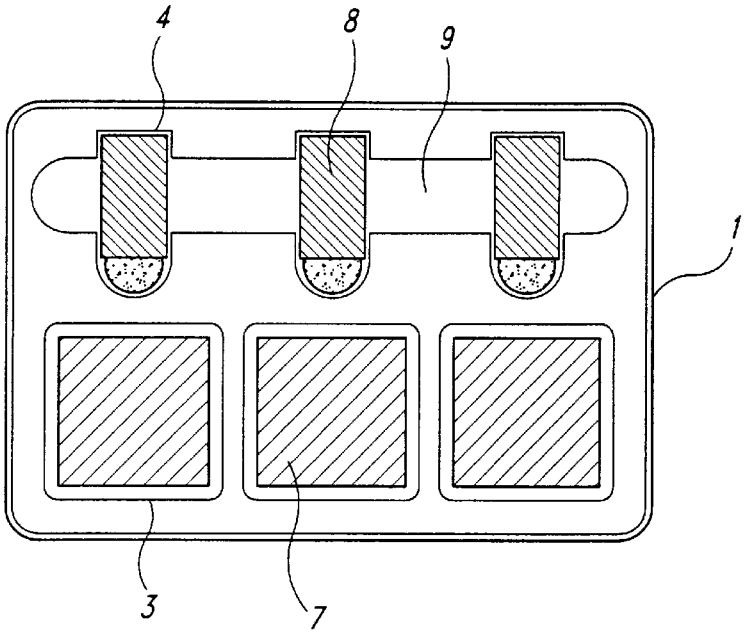
FIG. 6 is an explanatory diagram which illustrates how the ink pads and stencil brushes are stored in the stencil case of FIG. 1.

FIG. 6 is an explanatory diagram illustrating how the ink pads and stencil brushes are stored in the unit (1) of the stencil case of FIG. 1. As illustrated in FIG. 6, the stencil set located in a case of the present invention is characterized by storing several different colors of ink pads (7) in several ink pad storage slots (3) that are provided in parallel in the unit (1) of a stencil case such as illustrated in FIG. 1, and by storing the same number of stencil brushes (8) as the number of ink pads (7) in the brush storage slots (4) that are provided in parallel at a position opposite to the ink pad storage slots (3). When it is not in use, the base (1) is covered with the lid (2) in order to prevent the ink from evaporating. While it is in use, the lid (2) will be removed, and the user will slightly tap the stencil brush (8) on the ink pad (7) to absorb ink to be used for stenciling. In the example illustrated in FIG. 6, the ink pads (7) are compact stamp pads.

The stencil case of the present invention has several ink pad storage slots (3) provided in parallel and the same number of brush storage slots (4) provided in parallel at a position opposite to the ink pad storage slots (3). Thus, when different colors of ink pads and the same number of stencil brushes are stored in the ink pad storage slots (3) and the brush storage slots (4), respectively, the user can use one stencil brush for each ink pad color. Also, because one stencil brush is arranged at a position opposite to one ink pad color, the brush and pad together form a pair, and the same color of ink can be easily used many times. The problem of transferring different colors of ink onto a stencil brush will be eliminated.

Also, as illustrated in FIG. 1, concave part (9) joins each of the brush storage slots (4*a*), (4*b*), and (4*c*) in a direction parallel to the arrangement direction. Thus, when the fingers of the user pick up the stencil brush, which is stored in a brush storage slot (4), to transfer ink to the brush, the fingers will be fitted in the concave parts (9) on each side of the brush storage slot (4). So, it will be easy to pick up the stencil brush. Also, when returning the brush to the brush storage slot (4), it will be easy because two fingers will be fitted in the concave parts (9) in the same manner.

In the present invention, the unit and the lid may be separate as illustrated in FIG. 1, or the unit and the lid may be attached with hinges.

Figure 7:
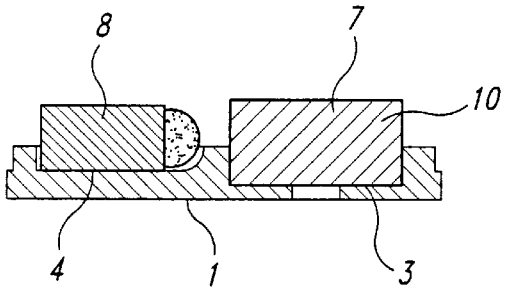
FIG. 7 is a cross-sectional outline which illustrates how the ink pads are stored in the ink pad storage slots of the unit.

As illustrated in FIG. 7, the ink pad (7) stored in the ink pad storage slot (3) may be the type which is characterized by attaching an ink occlusion body (10) in the ink pad storage slot (3) and by having the ink occlusion body (10) absorb ink. In such a case, if an inner lid that covers and seals the parallel ink pad storage slots is provided to concurrently cover and seal the ink pads, it will constitute a double lid, and such a structure will allow the ink to be completely prevented from evaporating and drying.

Figure 8:
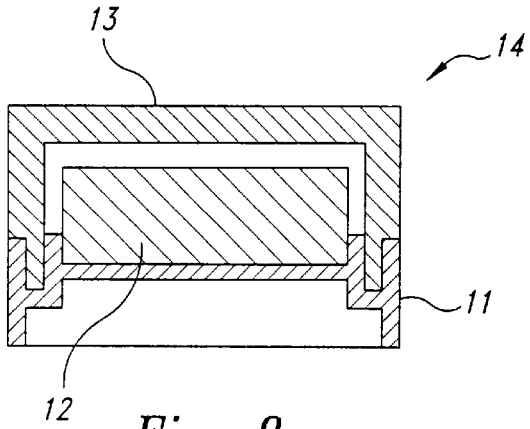
FIG. 8 is an explanatory diagram which illustrates a stamp pad as another example of an ink pad.

Another example of an ink pad that is stored in the ink pad storage slot (3) is illustrated in FIG. 8. A small stamp pad (14) with ink absorbed in an ink occlusion body (12) is provided on the base (11); the pad is covered with a small lid (13). By fitting such a stamp pad (14) into the ink pad storage slot (3) in such a manner that it can be fitted or removed freely, the ink can be easily stored or replaced without soiling the hand. In this case, if more than one stamp pad (14) of each color is separately prepared, it will be economical because, when the ink of one stamp pad color runs out among several stamp pad colors, or when the ink occlusion body is broken, such unusable stamp pad can be replaced with a new stamp pad of the same color. If the user wishes to make stencils using another color, the user can replace a stamp pad with another stamp pad color. The colors can be selected as desired.

Also, if a hole penetrating to outside of the unit is provided under the ink pad storage slot, the stamp pad can be easily removed by poking a finger through the hole when the stamp pad needs to be replaced.

Figure 9:
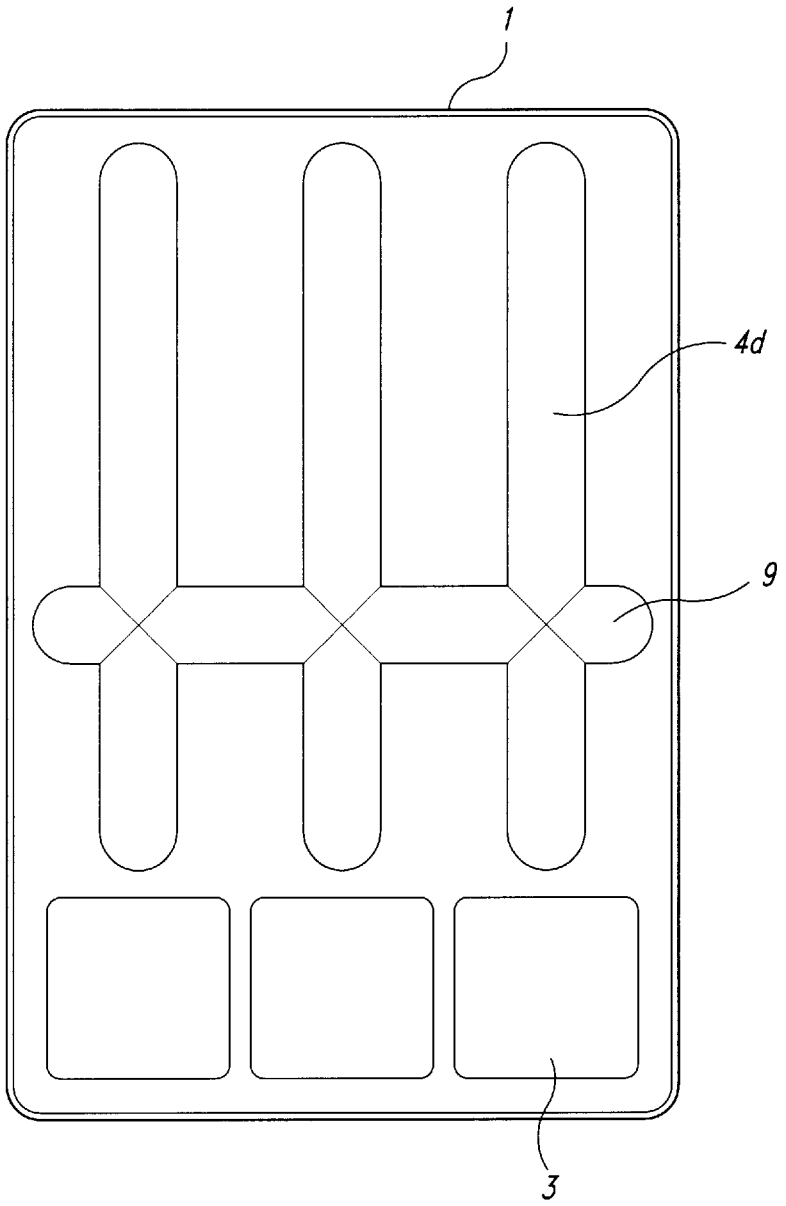
FIG. 9 is a top view which illustrates another example of the base for the stencil case unit of the present invention.

The example of the stencil case unit illustrated in FIG. 1 uses stencil brushes that are relatively short. To use stencil brushes that are relatively long, the brush storage slots (4*d*) of the unit (1) can be made long enough to store long stencil brushes as illustrated in FIG. 9.

Figure 10:
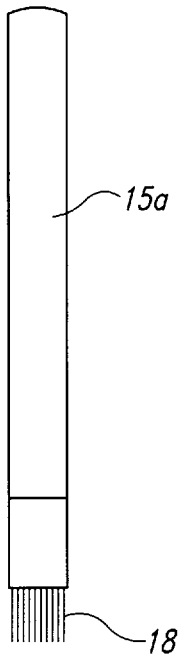
FIG. 10 is an explanatory diagram which illustrates an example of the stencil brush used in the present invention.
Figure 11:
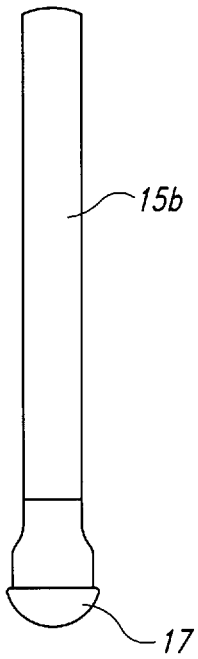
FIG. 11 is an explanatory diagram which illustrates another example of the stencil brush used in the present invention.

The stencil brushes used in the present invention are not particularly limited. For instance, FIG. 10 illustrates a brush having a hair part (16) made of animal hair at the tip of a handle (15*a*) made of wood. FIG. 11 illustrates a brush having a bamboo handle (15*b*) and an ink absorbing part (17) composed of polyurethane sponge, etc., at the tip of the handle (15*b*). Hard plastic may also be used for the handle.

Figure 12:
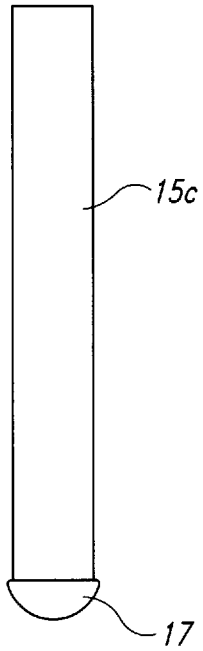
FIG. 12 is an explanatory diagram which illustrates another example of the stencil brush used in the present invention.
Figure 13:
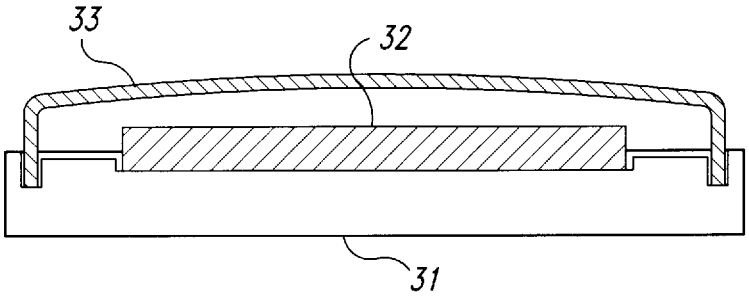
Fig. 13 (PRIOR ART)
FIG. 13 is a cross-sectional outline which illustrates a conventional stamp pad.
Figure 14:
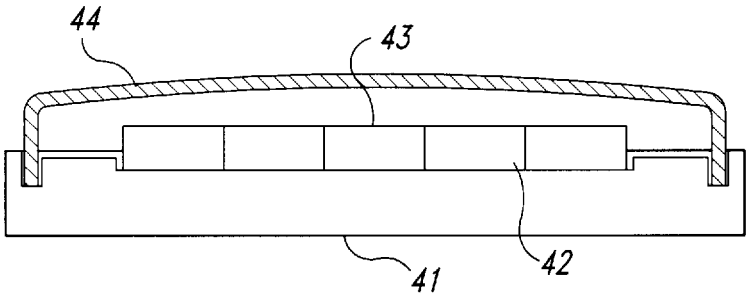
Fig. 14 (PRIOR ART)
FIG. 14 outlines a cross-sectional view which illustrates a conventional multicolor stamp pad.

Other preferable stencil brushes that can be used have an ink absorbing part (17) provided on a handle (15*c*) made of buffer material or elastic material as illustrated in FIG. 12.

The buffer material of the handle (15*c*) in FIG. 12 may be any material that has buffer characteristics and is at least hard enough to transmit the tapping force to the ink absorbing part (17). For instance, plastic foam, rubber foam, or other foam or sponges are preferable. Concrete examples may include plastic foam or sponge of polyethylene, ethylene-vinyl acetic acid copolymer (EVA), and rubber foam or sponge such as SBR, NBR, etc.

The elastic material for the handle (15*c*) may be any material that has elasticity and is at least hard enough to transmit the tapping force to the ink absorbing part (17). For instance, cork or rubber is preferable. Such cork may be comprised of molding natural cork or hardening cork crumbs with adhesives or rubber, and molding them.

Such a stencil brush can be easily prepared by using an adhesive to attach the ink absorbing part (17) to the tip of the handle (15*c*) composed of buffer material or elastic material.

Such a stencil brush is resilient, because the handle of the stencil brush is made of buffer material or elastic material. Thus, the impact of the tapping force when the stencil brush is used to imprint ink can be absorbed by the buffer material of the handle. Therefore, the hand will not become tired even if the user taps the stencil brush for a long time period. Also, because the handle of the stencil brush is composed of buffer material or elastic material to provide buffer characteristics or elasticity, the tapping force on the handle will be relieved, and there will be close contact between the ink absorbing part, stencil, and paper. The amount of ink applied by one tapping will also increase, and the number of taps can be reduced.

The handle of the stencil brush can have any arbitrary length. For instance, it may be a length at which the handle can be held with 2 fingers, like holding a pencil, to tap on the stencil. It may be a length, for instance, approximately 20–30 mm, which is long enough for the user to support the handle wall with his thumb and middle finger and press the upper end of the handle with the index finger. With this length, tapping can be done stably because three fingers are used. It is also preferable because the hand will not become tired even if tapping continues for a long time period.

APPLICATION EXAMPLES

The present invention will be explained in concrete terms next with application examples.

APPLICATION EXAMPLE 1

Three stamp pads of red, yellow, and green were prepared as illustrated in FIG. 8.

In the concave part provided on the base, the sponge ink occlusion bodies were attached. The ink occlusion bodies had water-based red, yellow, and green ink absorbed, respectively, and were covered with small lids. In this manner, three stamp pads of 33 mm (length)×33 mm (width) ×20 mm (height) were prepared.

Next, stencil brushes using buffer material for the handle were prepared.

As the buffer material, polyethylene foam sheet of 25 mm thick was punched out with a punching blade to make a handle of cylindrical polyethylene foam with a length of 22 mm and a diameter of 15 mm. An ink absorbing polyurethane sponge in the shape of a hemisphere and having a diameter of 15 mm that forms a spherical surface upward was attached with an adhesive to the tip of the handle, to prepare the stencil brush.

Next, the unit and the lid of the stencil case as illustrated in FIG. 1 were prepared by molding polystyrene resin. In the unit, each of the three ink pad storage slots and brush storage slots were provided in parallel. The sizes of such slots were made to be large enough to store the aforementioned stamp pads and stencil brushes. In the brush storage slot, concave parts joining each of the brush storage slots were provided parallel to the arrangement direction.

Each of the three aforementioned stamp pads and stencil brushes were stored in the unit of the stencil case. Stencils were made on 300 sheets of paper by removing the small lids of the stamp pads, attaching a stencil with flower patterns punched out on paper, transferring the ink from the stamp pads to the ink absorbing part of the stencil brush, and slightly tapping the brush on the top of the stencil and alternately imprinting three colors of ink.

Since each of the three stamp pads and stencil brushes used for stencils were stored in an arrangement in the case opposite to each other, one stencil brush can be used for one stamp pad color. Thus, the predetermined same ink color can be easily used any time. There were no errors such as attaching the wrong ink color on the stencil brush.

Also, because the concave parts are provided joining each of the brush storage slots parallel to the arrangement direction in the brush storage slots, it was easy to pick up or put back the stencil brushes with two fingers. Thus, the work was performed efficiently.

Also, because the handle of the stencil brush used in the present application example was made of buffer material to provide buffer characteristics, the tapping force on the handle was relieved by the buffer material. Thus, the hand did not get tired even if the user stenciled for a long time. Additionally, there was close contact between the ink absorbing part, stencil, and paper, so the amount of ink applied by one tap increased, and the number of times the brush had to be tapped was reduced.

EFFECT OF THE INVENTION

As explained above, by the present invention, several ink pads and several stencil brushes used for stenciling are stored in a case opposite to each other. Thus, one stencil brush can be used for one stamp pad color. Thus, the same ink color can be easily used with the same brush at any time, and stenciling is performed efficiently. When not in use, the brushes can be organized and stored in the case.

Also, because the concave parts are provided joining each of the ink pad storage slots parallel to the arrangement direction in the brush storage slots, it is easy to pick up the stencil brush to apply ink, or to put it down with two fingers. Thus, work is efficient.

I claim:

1. A stencil set, comprising:

a base having a plurality of parallel ink pad storage slots and an equal plurality of parallel, elongated brush storage slots opposite the ink pad storage slots;

a plurality of ink pads each having one of an equal plurality of colors and being disposed in one of the plurality of ink pad storage slots each ink pad comprising a stamp pad having ink absorbed in an ink occlusion body, each stamp pad being disposed on the base and covered by its own lid; and an equal plurality of stencil brushes stored in the elongated brush storage slots.

2. A stencil set, comprising:

a base having a plurality of parallel ink pad storage slots and an equal plurality of parallel elongated brush storage slots opposite the ink pad storage slots;

a plurality of ink pads, each having one of an equal plurality of colors and being disposed in one of the plurality of ink pad storage slots, each ink pad comprising a stamp pad that has ink absorbed in an ink occlusion body, is removably fitted into a corresponding one of the plurality of ink pad storage slots, and is covered by its own lid; and an equal plurality of stencil brushes stored in the elongated brush storage slots.

3. A stencil set comprising:

a base having a plurality of parallel ink pad storage slots and an equal plurality of parallel, elongated brush storage slots opposite the ink pad storage slots, the base further having at least one opening under one of the plurality of ink pad storage slots that opens to the outside of the base;

a plurality of ink pads, each having one of an equal plurality of colors and being disposed in one of the plurality of ink pad storage slots, each ink pad comprising a stamp pad that has ink absorbed in an ink occlusion body, is removably fitted into a corresponding one of the plurality of ink pad storage slots and is covered by its own lid; and an equal plurality of stencil brushes stored in the elongated brush storage slots.

* * * * *